US010677559B2

(12) United States Patent
Davies

(10) Patent No.: US 10,677,559 B2
(45) Date of Patent: Jun. 9, 2020

(54) METHOD OF SLOWING DOWN A MOVING PROJECTILE

(71) Applicant: BAE SYSTEMS plc, London (GB)

(72) Inventor: Raymond Charles Davies, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 16/469,961

(22) PCT Filed: Nov. 28, 2017

(86) PCT No.: PCT/GB2017/053579
§ 371 (c)(1),
(2) Date: Jun. 14, 2019

(87) PCT Pub. No.: WO2018/109434
PCT Pub. Date: Jun. 21, 2018

(65) Prior Publication Data

US 2020/0080814 A1 Mar. 12, 2020

(30) Foreign Application Priority Data

Dec. 16, 2016 (GB) ..... 1621489.2
Jan. 18, 2017 (EP) ..... 17152020

(51) Int. Cl.
*H02K 41/02* (2006.01)
*F41B 6/00* (2006.01)
*F41J 13/00* (2009.01)

(52) U.S. Cl.
CPC ..... *F41B 6/006* (2013.01); *F41J 13/00* (2013.01)

(58) Field of Classification Search
CPC ... F41B 6/003; F41B 6/006; F41B 6/00; F41J 13/00
USPC ..... 310/12.07; 89/8; 124/3; 73/12.11; 318/135
See application file for complete search history.

(56) References Cited

U.S. PATENT DOCUMENTS 3,857,050 A 12/1974 Harris et al.
4,319,168 A * 3/1982 Kemeny ..... F41B 6/006 104/282
4,432,333 A 2/1984 Kurherr
4,938,113 A * 7/1990 Kemeny ..... F41B 6/006 124/3
5,081,901 A * 1/1992 Kemeny ..... F41G 3/12 124/3

(Continued)

FOREIGN PATENT DOCUMENTS

WO 2018109434 A1 6/2018

OTHER PUBLICATIONS

International Search Report and Written Opinion for PCT Application No. PCT/GB2017/053579, dated Feb. 21, 2018. 11 pages.

(Continued)

*Primary Examiner* — Thanh Lam
(74) *Attorney, Agent, or Firm* — Finch & Maloney PLLC

(57) ABSTRACT

According to a first aspect of the present invention, there is provided a method of slowing down a moving projectile, the projectile moving within an electromagnetic railgun, the method comprising: using an electromagnetic field generated by the railgun to slow down the projectile, wherein the projectile is a munitions projectile, and/or a carrier for catching the munitions projectile.

15 Claims, 4 Drawing Sheets

(56) References Cited

U.S. PATENT DOCUMENTS

Figure 1:
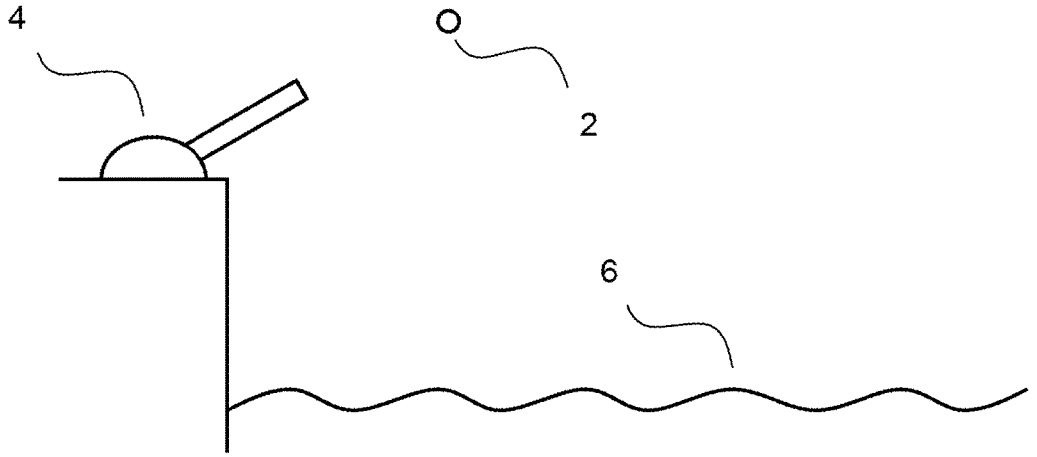

| | | | | |
|---|---|---|---|---|
| 5,528,974 | A | 6/1996 | Yoshida et al. | |
| 5,788,180 | A * | 8/1998 | Sallee | F41G 7/222 244/3.15 |
| 7,832,385 | B1 * | 11/2010 | Kapinski | F41B 6/006 124/3 |
| 2016/0245613 | A1 * | 8/2016 | Grossnickle | F41B 6/003 |
| 2016/0341514 | A1 * | 11/2016 | Grace | F41A 1/02 |

OTHER PUBLICATIONS

GB Search Report under Section 17(5) for GB Application No. 1621489.2, dated Mar. 21, 2017. 3 pages.
International Preliminary Report on Patentability for PCT Application No. PCT/GB2017/053579, dated Jun. 18, 2019. 6 pages.

* cited by examiner

METHOD OF SLOWING DOWN A MOVING PROJECTILE

The present invention relates generally to a method of slowing down a moving projectile, and to a related system. In particular, the projectile is a munitions projectile, and/or a carrier for catching such a munitions projectile.

The recovery of munitions projectiles is an important capability required during the research and development of such projectiles. Recovery can also be useful as a diagnostic technique, for example if and when investigating incidents or similar involving such munitions projectiles. Ideally, the recovery is a "soft" recovery, in that as little damage as possible is incurred by the munitions projectile during the recovery process. This means that the effects of launch or firing of the projectile can be studied with more reliability, and for example without having to determine what features on or of the projectile have come into being as a result of the recovery process.

There are numerous different soft recovery methods. However, each existing recovery method has one or more significant associated disadvantages.

It is therefore an example aim of example embodiments of the present invention to at least partially avoid, solve or overcome one or more problems associated with the prior art, whether identified herein or elsewhere, or to at least provide an alternative to the prior art.

According to a first aspect of the present invention, there is provided a method of slowing down a moving projectile, the projectile moving within an electromagnetic railgun, the method comprising: using an electromagnetic field generated by the railgun to slow down the projectile, wherein the projectile is a munitions projectile, and/or a carrier for catching the munitions projectile.

The carrier may initially be located within the electromagnetic railgun, and be used to catch the moving munitions projectile. The method may further comprise using an electromagnetic field generated by the railgun to slow down the carrier.

The method may comprise moving the carrier in the same direction of movement of the munitions projectile, downstream of the munitions projectile, before the munitions projectile is caught by the carrier.

The method may comprise moving the carrier to a speed that is a significant factor of, or substantially the same as, or just below, the speed of the munitions projectile.

The method may comprise using an electromagnetic field generated by the or another railgun to move the carrier in the same direction of movement of the munitions projectile.

The method may comprise switching the polarity or otherwise controlling the same railgun to: firstly, generate an electromagnetic field to move the carrier in the same direction of movement of the munitions projectile, downstream of the munitions projectile, before the munitions projectile is caught by the carrier; secondly, generate an electromagnetic field to slow down the carrier, once the carrier has caught the munitions projectile.

The method may comprise: using a first electromagnetic railgun to generate an electromagnetic field to move the carrier in the same direction of movement of the munitions projectile, downstream of the munitions projectile, before the munitions projectile is caught by the carrier; and using a second electromagnetic railgun to receive the carrier, and to generate an electromagnetic field to slow down the carrier, once the carrier has caught the munitions projectile.

The electromagnetic field may be used to slow down the carrier based on one or more of: an expected time at which the carrier is expected to catch the munitions projectile, related to initial movement, or movement, of the munitions projectile and/or carrier; a sensed time or event at which the carrier is expected to catch the munitions projectile, or has caught the munitions projectile.

The method may comprise firing the munitions projectile into the railgun.

The munitions projectile may be fired using one or more of an explosive or a propellant.

The method may comprise slowing down the munitions projectile before the munitions projectile enters the rail gun.

The carrier may be deformable.

According to a second aspect of the invention, there is provided a method of recovering a munitions projectile fired using an explosive or propellant, the method comprising the use of the method the first aspect of the invention.

According to a third aspect of the invention, there is provided a system for slowing down a moving projectile, the system comprising: an electromagnetic railgun, within which the projectile can move; a controller arranged to control the railgun, such that an electromagnetic field generated by the railgun is used to slow down the projectile, wherein the projectile is a munitions projectile, and/or a carrier for catching the munitions projectile.

According to a fourth aspect of the invention, there is provided a system for recovering a munitions projectile fired using an explosive or propellant, the system comprising the system of the third aspect of the invention.

It will be appreciated that any one or more features described in relation to a method-like aspect of the invention may, where appropriate, apply to systems/apparatus-like aspects. It will be appreciated that any one or more features described in relation to a system/apparatus-like aspect of the invention may, where appropriate, apply to method-like aspects.

Figure 2:
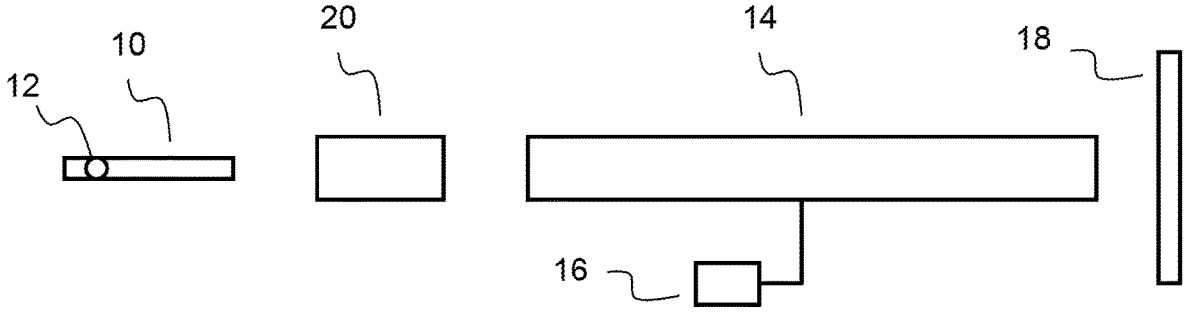
Figure 3:
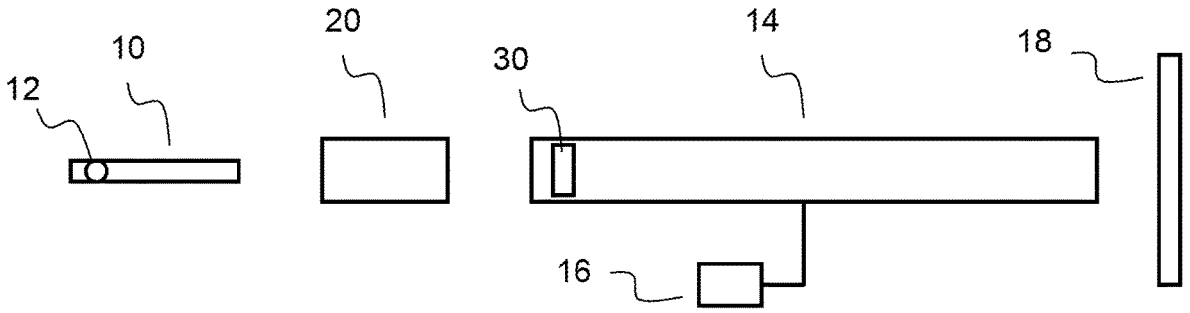

As an aid to understanding the features of the present invention, the invention and related features can now be described in more detail, by way of example only, with reference to the following Figures:

FIG. 1 schematically depicts an existing soft recovery method;

FIG. 2 schematically depicts a system for slowing down a moving projectile in accordance with an example embodiment;

FIG. 3 schematically depicts a system for slowing down a moving projectile, in accordance with another example embodiment of the present invention;

FIGS. 4-8 schematically depict use of the system of FIG. 3; and

Figure 9:
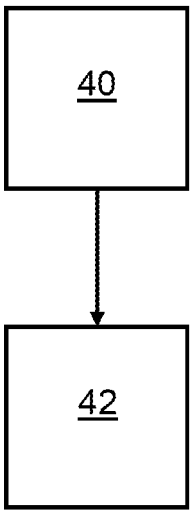

FIG. 9 schematically depicts general methodology associated with example embodiments of the present invention.

FIG. 1 schematically depicts an existing method for slowing down and ultimately recovering a moving projectile, and particularly a munitions projectile. The method comprises firing a munitions projectile (2) from a suitable weapon (4). The projectile (2) is fired into an aquatic environment, for example a large body of water such as a sea or ocean (6). The projectile (2) is later recovered from the body of water (6), for example for inspection of the projectile (2).

The methodology as explained with reference to FIG. 1 may work perfectly well in certain circumstances. However, there are significant disadvantages associated with this methodology. Firstly, the body of water (6) into which the projectile (2) is fired might need to be incredibly large to be of practical use, for example, when projectiles might have a trajectory extending over kilometres or even tens of kilometres. This, of course, restricts the use of the methodology to, typically, coastal or open-sea environments. Recovery of projectiles (2) fired into such aquatic environments might be difficult. If the projectile (2) cannot be successfully recovered, this of course has impact both in terms of the success of the recovery operation and inspection or similar of the projectile (2), but also in terms of possible environmental impact and similar. Also, when the projectile (2) impacts upon the surface of the body of water (6), the projectile (2) will still have significant kinetic energy. The impact with the body of water (6) can cause damage to the projectile (2). It might be desirable to avoid such damage, so that any damage, marking, or similar to the projectile can be attributed to the firing or flight of the projectile (2), to assist in inspection, research and development.

Alternatives to the recovery methodology as shown in FIG. 1 are, of course, possible. In one example, a projectile, once it has been fired, may be slowed by the use of air pressure vented through an orifice plate or similar. However, such methodology may be limited to an upper threshold projectile calibre, or such methodology may not slow and stop the projectile over a distance that is desirable (within a short-enough distance). An alternative might be the use of pressurised tube sections, with burster discs located in between each section, through which the projectile is fired. However, this system has been found to be complicated and problematic to use in practice.

There is therefore clearly a need to provide a recovery method and system for slowing down a moving projectile, that overcomes the one or more problems discussed above.

According to an example embodiment, it has been realised that electromagnetic railgun technology can be used to avoid or overcome at least some of the problems discussed above. Conventionally, electromagnetic railgun technology is used to launch or fire projectiles. Counter-intuitively and surprisingly, it has been realised that similar physical principles can be used to slow down a moving projectile, and thus be used as part of a soft recovery method and system. The use of electromagnetic railgun technology is particularly advantageous, in that the munitions projectile can be made to slow down in a quick and controlled manner, reducing the space or footprint for the system as a whole, but at the same time reducing any impact that might otherwise be imparted on the projectile as part of the recovery process. A carrier may also be used to assist in catching and capturing the munitions projectile. As opposed to needing to configure or re-configure an entire system for different types of munitions projectiles (e.g. of different calibres), the carrier can be configured, or re-configured in a much more convenient manner, while leaving the remainder of the core of the system intact.

Example embodiments of the present invention will now be described by way of example only, with reference to explanatory and diagrammatic FIGS. 2 to 9.

FIG. 2 shows a gun (10) within which is located a projectile (12) to be fired from the gun (10). Downstream (in terms of the ultimate trajectory of the projectile (12)) is located in an electromagnetic railgun (14). The railgun (14) is connected to, or comprises, a controller (16). Downstream of the electromagnetic railgun (14) is a sand butt or similar catch or stop (18), for use in possible stopping of the projectile (12), for example as a safety full-back, or even as part of the soft recovery as a whole.

Optionally located in-between the gun (10) and the electromagnetic railgun (14) is an initial alignment and/or retardation element (20). This element (20) may be configured to assist in aligning the trajectory of the projectile (12) with the railgun (14) or one or more parts of the railgun (14), for example rails of the railgun (14), or a space between such rails. Alignment could be achieved by appropriate shaping of, for example, an internal space of the element (20) through which the projectile (12) travels, for example using one or more guiding surfaces or elements. Alternatively or additionally, that same element might be used to slow down the projectile (12) before the projectile (12) enters the railgun (14). Slowing down the projectile (12) in this way might mean that the structural or power requirements of the electromagnetic railgun (14) are conveniently reduced. Slowing down could be achieved using one or more pressurised air or gas regions within the element (20). Pressurisation could be maintained using one or more surfaces (e.g. discs), which could be penetrated by the projectile (12) as it passes through the element (20) and the regions within.

In use, the gun (10) fires the projectile (12). The firing may be conventional, in the sense that the firing is undertaken using an explosive (e.g. charge) or propellant. Effects of this conventional firing on the projectile can then be subsequently analysed, once slowing and recovery of the projectile (12) has taken place.

The projectile (12) optionally passes through the alignment or retardation element (20), where alignment or re-alignment of the projectile's trajectory might take place, and/or slowing of the projectile's (12) speed may take place, before entry into the railgun (14).

The railgun (14) is then appropriately controlled by controller (16) to generate an electromagnetic field suitable for slowing down the projectile (12). The projectile (12) can be slowed to whatever speed is desired. For example, the projectile (12) could be slowed to the extent that it is stopped within the railgun (14), or such that the projectile (12) slowly exits from and falls from the railgun (14) (for example, into an optional carrier or similar), or to the extent that the impact on the sand butt (or general capture element) (18) does not cause damage or significant damage to the projectile.

A railgun typically uses a pair of parallel conductors, or rails, along which a sliding electrically conductive (e.g. metallic) armature or similar is accelerated by electromagnetic effects of a current that flows down one rail, into the armature, and then back along the rail. Herein, the railgun is used with the opposite principles, where an initially mobile armature, moving at great speed (e.g. the speed of the projectile) is decelerated by electromagnetic effects of a current that flows down one rail, into the armature, and then back down the other rail.

Of course, railgun technology is known, and the invention is not directed to particular powers or operating principles of a particular railgun. Instead, the invention is directed towards the use of a railgun in a particular application. It will be appreciated by the skilled person, from a reading of this disclosure, that the structure and operating powers of the railgun will be appropriately chosen for the particular application, for example the type of projectile that is expected to be used with the method and system, or based on upper limits of such projectiles, for example in terms of kinetic energy, calibre and so on.

A problem with use of the system of FIG. 2 is how to provide an armature that bridges the rails of the railgun (14). One way to do this would be to ensure that the projectile (2) itself was the armature, and/or is provided with this armature, for example by way of an electrically conductive (e.g. metal) casing, housing or jacket that is associated with the projectile. Once in the railgun, the armature would bridge the rails of the railgun (14) allowing deceleration of the projectile (2) to take place. However, in practice, it is likely to be extremely difficult to implement such a system, where the projectile comprises or is in some way associated with an armature which enters the railgun (14). For example, there may be problems with alignment of the armature with the elements of the railgun, or negative implications on the design, trajectory or firing properties or effects of the projectile with the presence of the armature.

In order to overcome those problems, it has been realised that the railgun might already be provided with such an armature, as with a conventional railgun. However, in this example, the armature will not only be used to bridge the rails of the railgun, but may also form part of, or at least be associated with, a carrier for catching (i.e. an object for assisting in the slowing of) the projectile itself. Such an approach is thus a more convenient way for effectively slowing down and recovering the projectile using electromagnetic railgun technology.

FIG. 3 shows a modification to the system already shown in and described with reference to FIG. 2. The modification comprises the additional use and presence of a carrier (30) for catching the munitions projectile (12).

The carrier (30) is suitable for catching the munitions projectile (12), and preferably causing little or no damage to the munitions projectile during the catching process. To this extent, the carrier, or at least a part thereof, may be deformable in some way. This may be due to material properties of one or more parts of the carrier (30), or due to movement of one or more parts of the carrier (30). As discussed above, the carrier (30) may be the armature that bridges rails of the railgun (14) or may be associated with such an armature, for example, initially resting against or being attached to such an armature.

Another advantage with the use of such a carrier (30) is that the carrier can be readily modified or configured, or re-configured to take into account different types of projectile, for example different shapes of projectile, different size, different calibre, different kinetic energy and so on. So, the system as a whole could be designed and implemented to accommodate projectiles of an upper, threshold or maximum calibre, whereas the carrier can be configured to accommodate projectiles of a smaller calibre. This way, only the carrier (30) needs to be modified, or configured, or re-configured to take into account different calibre munitions projectiles, as opposed to completely re-designing the entire system. This is of course more efficient and cost-effective.

The carrier (30) might take one of a number of different forms, depending on the application, which would include the nature of the munitions projectile (12). The carrier (30) might comprise one or more surfaces that span the majority of the space between rails of the railgun (14). The carrier (30) might comprise one or more surfaces that span only a space between rails of the railgun (14) within which the munitions projectile (12) is expected to impact the carrier (30). The surface could be a single sheet, or a sheet with apertures, or a mesh, or interlinked elements. Multiple surfaces could be provided, across a width of the carrier (i.e. transverse to carrier/projectile movement), or along a depth of the carrier (i.e. in the direction of carrier/projectile movement). Different surfaces might have different properties, for example in terms of impact absorption. The carrier (30) could be attached to and slide along the rails of the railgun (14), especially if the carrier (30) comprises or is attached to the armature of the railgun (14). The carrier (30) could be attached to and guided by different guides or rails, separate to those required for operation of the railgun (14), for example a parallel set of guides or rails.

In use, the system of FIG. 3 may be implemented much as with the system of FIG. 2, with the exception that the use of the carrier (30) means that the projectile (12) does not need to be provided with or otherwise associated with an armature before entering the railgun (14), thus overcoming disadvantages with that approach. However, a problem associated with the implementation of FIG. 3 is that, even if deformable, it may be difficult or impossible to successfully catch the projectile (12) with the carrier (30) without causing damage to one or both of the carrier (30) or projectile (12), simply due to the extremely high kinetic energy that the projectile (12) is likely to have.

It has been realised that the use of the carrier principle can be significantly improved by ensuring that the carrier (30) is not stationary when it is impacted upon by the munitions projectile (12)—i.e. the carrier is moved. For instance, if the carrier (30) is made to move in the same general direction of movement as the munitions projectile (12), and of course downstream of the munitions projectile (12), before the munitions projectile is caught by the carrier (30), the impact between the munitions projectile and the carrier will be reduced when the projectile is caught, whilst still allowing the carrier to successfully catch the munitions projectile, and then be slowed down by the railgun (14).

The carrier (30) could be made to move in any convenient manner, for example using explosives (e.g. a charge) or a propellant, for example using compressed air or similar. However, the system of FIG. 3 already provides an extremely convenient tool for moving an object quickly and efficiently—the railgun itself. Thus, it has been realised that the railgun can be used to move the carrier downstream of the projectile, before the carrier catches the projectile, and the same railgun can be used to slow down the carrier and projectile for recovery.

Of course, a first railgun or railgun portion could be used to move the carrier in this way, and a second railgun or railgun portion could be used to then decelerate the carrier and projectile. However, even more conveniently, this functionality can be achieved using a single railgun with appropriate control of the railgun, as shown in and described with reference to FIGS. 4 to 8.

Figure 4:
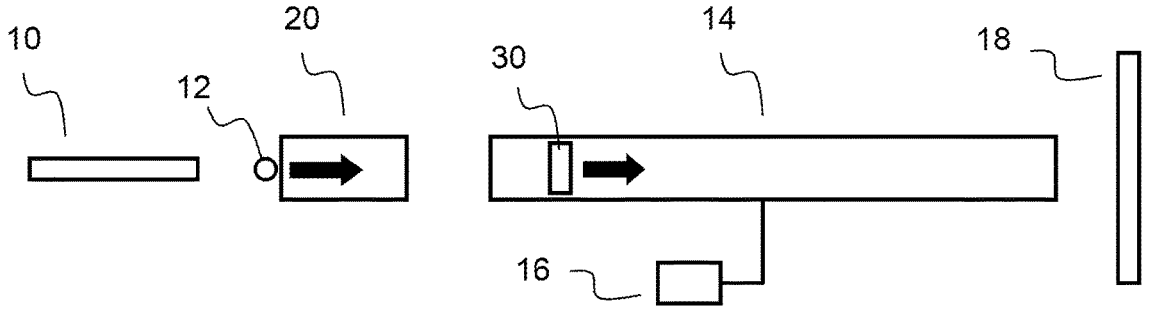

The operation of the system of FIG. 4 is similar to the operation of the system shown in and with reference to FIGS. 2 and 3. Differences will now be described.

FIG. 4 shows that the gun (10) has fired the projectile (12). In response to the firing of the projectile (12), the railgun (14) is controlled (16) to accelerate the carrier in the same direction of movement of the munitions projectile (12) and, or course, downstream of that projectile (12).

The railgun (14) may be controlled (16) to begin moving the carrier (30) at any appropriate time, for example based on an expected time which the carrier (30) is expected to catch the munitions projectile (12), related to the initial movement, or movement, of the munitions projectile, or a sensed time or event at which the carrier is expected to catch the munitions projectile. For instance, firing of the gun (10) may be used to in some way trigger the movement of the carrier (30), or the beginning of the movement process.

Figure 5:
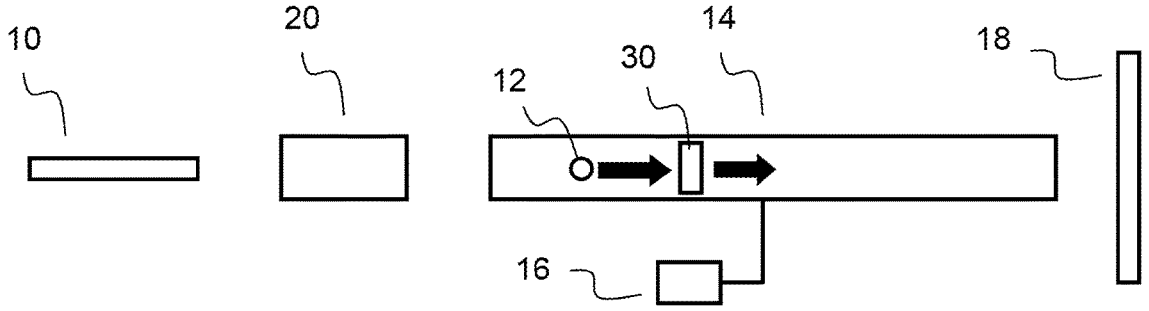

FIG. 5 shows that the carrier (30) is now moving in the same direction as, and ahead of, the projectile (12). The carrier (30) is moved up to a speed that is a significant factor of, and perhaps close to and at one point perhaps even matching, the speed of the projectile (12). This is to minimise the change in momentum, and thus impact, on or of the projectile (12) or of the carrier (30) when the two come into contact with one another, and when the projectile (12) is caught by the carrier (30).

The exact speed or acceleration of the carrier (30) will be application specific. Of course, the important thing is that the carrier (30) can catch the projectile (12) without causing significant damage to one or both of the carrier (30) or projectile (12). It may be acceptable for the carrier (30) to be damaged, even permanently so, during the catching process. It is perhaps more important for the projectile (12) to remain undamaged as a result of the catching, so that the projectile (12) can be reliably inspected to determine any features on the projectile (12), or of the projectile (12), resulting from the launch or firing of the projectile (12).

Figure 6:
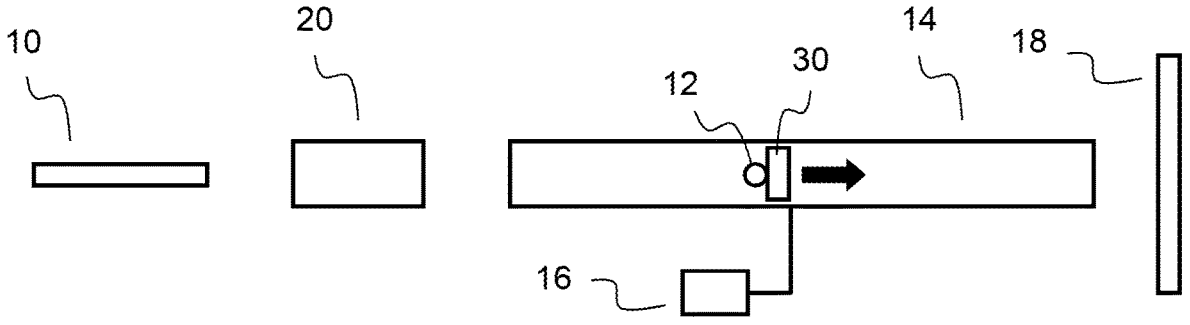

FIG. 6 shows the time when the projectile (12) makes contact with and is caught by the carrier (30).

Figure 7:
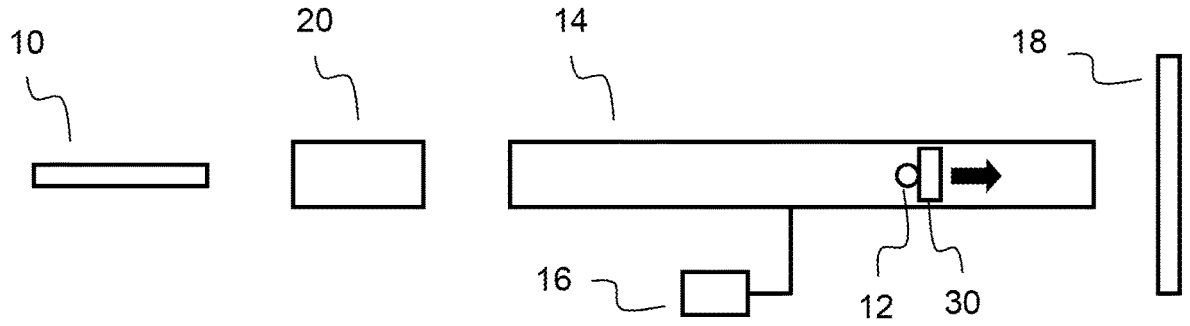

FIG. 7 shows that, subsequent to the time shown in FIG. 6, the railgun (14) is controlled (16) to generate an electromagnetic field to slow down the carrier (30), once the carrier (30) has caught the munitions projectile (12). This might be most conveniently achieved by switching the polarity of the railgun (14)—i.e. such that the current flows in an opposite direction through the armature connecting rails of the railgun, thereby ensuring that the magnetic fields extend or exert a force in the opposite direction.

While the railgun (14) is controlled (16) to generate an electromagnetic field to slow down the carrier (30), once the carrier (30) has caught the munitions projectile (12), the railgun (14) might be controlled (16) to generate an electromagnetic field to slow down the carrier (30), just before the carrier (30) has caught the munitions projectile (12), for example to bring the carrier (30) into contact with the munitions projectile (12).

As with the movement of the carrier (30), the switch from controlling the railgun (14) to accelerate the carrier (30) to controlling the railgun (14) to decelerate the carrier (30) may be based on an expected time at which the carrier is expected to catch the projectile (12), related to an initial movement, or movement, of the munitions projectile (12) or carrier (30), or a sensed time or event at which the carrier (30) is expected to catch the munitions projectile (12), or has caught the munitions projectile (13). For instance, it may be known that the projectile (12) should impact the carrier (13) at a certain time after the projectile (12) has been fired. After this time, it will be known that the polarity of the railgun (14) should be reversed, or the railgun (14) otherwise controlled (16) to ensure the carrier (30) has decelerated, having now caught the projectile (12). In another example, the projectile (12) entering the railgun (14) may be sensed, and used to trigger or control the railgun (14), or the projectile (12) approaching, being proximal to, or impacting upon the carrier (30) could be sensed and be used to trigger the control of the railgun (14).

Figure 8:
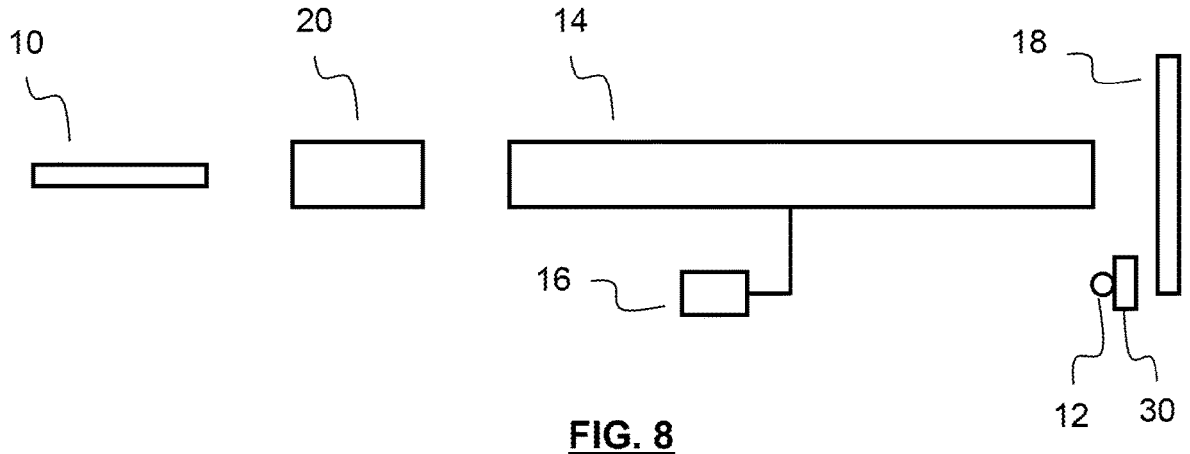

FIG. 8 shows that the projectile (12) can be conveniently recovered with the carrier (30) from the railgun (14). The deceleration of the carrier (30) and projectile (12) within the railgun (14) can be such that the carrier-projectile combination (30, 12) comes to rest within the railgun (14), from which rest position the projectile can be removed. Alternatively, the speed can be such that the carrier-projectile combination (30,12) is slowed to a certain extent, such that when the carrier-projectile combination (30,12) leaves the railgun it can be conveniently and safely collected by a catch or absorbing element, for example an absorbing surface, or a fluid or similar.

FIG. 9 schematically depicts general methodology associated with the principles discussed above. In very general terms, the method comprises slowing down a moving projectile, the projectile already moving within an electromagnetic railgun (14). The method comprises using an electromagnetic field generated by the railgun to slow down the projectile (42). The projectile may be a munitions projectile (i.e. a projectile fired by a weapon, or suitable for firing from a weapon, or similar) and/or a carrier for catching the munitions projectile, as discussed above.

The described system and method are very convenient for slowing and recovering a munitions projectile. The railgun (and, optionally, carrier) can be used to slow the munitions projectile in a very short distance, for example less than 200 m or less than 150 m or less than 100 m. This is compared with a typical trajectory of the munitions projectile of many kilometres, and perhaps evens tens of kilometres. Since the recovery requires little or no significant impact to the munitions projectile, the munitions projectile can be recovered and inspected in the knowledge that any alterations to the structure of the munitions projectile would have been caused, most likely, by the firing procedure. This helps with reliable inspection, testing and development processes. Since the recovery requires little or no significant impact to the munitions projectile, the described methods and systems could even be used with a live munitions projectile. With use of a carrier, the core elements of the system can be configured to accommodate projectiles of any expected calibre (or shape, etc.), and it can be the carrier that is configured to accommodate projectiles of a particular calibre (or shape, etc.). This would simplify design, build and maintenance steps and costs, since the core elements of the railgun are likely to be the most demanding in terms of construction, running and maintenance.

"Railgun" is a term of the art. However, "railgun" might be alternatively or additionally defined or described as: rail gun; electromagnetic projectile launcher (or in this case, arrestor); electromagnetic gun, or similar.

"Munitions projectile" has been used to describe the projectile that is slowed down, e.g. for recovery. A munitions projectile can be anything that might be used in a projectile weapon, for example a shell, mortar, rocket, missile, and so on. The projectile could be provided with its own propellant, for example a rocket or missile with a chemical propellant. The projectile could be unpowered, having no propellant, such that after firing no internally-provided driving force is provided in the direction of travel. For example, this might take the form of a shell.

The carrier described above can be used to catch and retain the munitions projectile. However, other implementations are possible. For example, the carrier might simply abut against the projectile, so that slowing of the carrier can be used to slow the munitions projectile. The carrier then carries the projectile in that control of carrier movement or speed, in turn, controls movement or speed of the projectile. If the carrier does in some way catch and retain the projectile (e.g. on or within a body of the carrier), this might be useful in removing the carrier-munitions projectile combination from the railgun, or for recovery of the munitions projectile in general. The carrier might offer some protection for the munitions projectile, for example if and when handling the projectile/carrier during recovery.

In this disclosure, "slowing down" has been used in relation to the projectile, which might be the munitions projectile, the carrier, or both. This action might be alternatively or additionally defined or described as one or more of: retarding; decelerating; reducing the speed; arresting, or similar. The carrier has been described as being moved, in advance of the munitions projectile. This moving action might alternatively or additionally be defined or described as one or more of: accelerating; increasing the speed, or similar.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of slowing down a moving projectile, the projectile moving within an electromagnetic railgun, the method comprising:

using an electromagnetic field generated by the railgun to slow down the projectile, wherein the projectile is a munitions projectile, and/or a carrier for catching the munitions projectile.

2. The method of claim 1, wherein the carrier is initially located within the electromagnetic railgun, and is used to catch the moving munitions projectile, and the method further comprises using an electromagnetic field generated by the railgun to slow down the carrier.

3. The method of claim 1, wherein the method comprises moving the carrier in the same direction of movement of the munitions projectile, downstream of the munitions projectile, before the munitions projectile is caught by the carrier.

4. The method of claim 1, wherein the method comprises moving the carrier to a speed that is a significant factor of, or substantially the same as, or just below, the speed of the munitions projectile.

5. The method of claim 3, wherein the method comprises using an electromagnetic field generated by the or another railgun to move the carrier in the same direction of movement of the munitions projectile.

6. The method of claim 1, wherein the method comprises switching the polarity or otherwise controlling the same railgun to:

firstly, generate an electromagnetic field to move the carrier in the same direction of movement of the munitions projectile, downstream of the munitions projectile, before the munitions projectile is caught by the carrier; and secondly, generate an electromagnetic field to slow down the carrier, once the carrier has caught the munitions projectile.

7. The method of claim 1, wherein the method comprises:

using a first electromagnetic railgun to generate an electromagnetic field to move the carrier in the same direction of movement of the munitions projectile, downstream of the munitions projectile, before the munitions projectile is caught by the carrier; and using a second electromagnetic railgun to receive the carrier, and to generate an electromagnetic field to slow down the carrier, once the carrier has caught the munitions projectile.

8. The method of claim 6, wherein the electromagnetic field is used to slow down the carrier based on one or more of:

an expected time at which the carrier is expected to catch the munitions projectile, related to initial movement, or movement, of the munitions projectile and/or carrier; and a sensed time or event at which the carrier is expected to catch the munitions projectile, or has caught the munitions projectile.

9. The method of claim 1, wherein the method comprises firing the munitions projectile into the railgun.

10. The method of claim 9, wherein the munitions projectile is fired using one or more of an explosive or a propellant.

11. The method of claim 9, wherein the method comprises slowing down the munitions projectile before the munitions projectile enters the rail gun.

12. The method of claim 1, wherein the carrier is deformable.

13. A method of recovering a munitions projectile fired using an explosive or propellant, the method comprising the use of the method of claim 1.

14. A system for slowing down a moving projectile, the system comprising:

an electromagnetic railgun, within which the projectile can move; and a controller arranged to control the railgun, such that an electromagnetic field generated by the railgun is used to slow down the projectile;

wherein the projectile is a munitions projectile, and/or a carrier for catching the munitions projectile.

15. A system for recovering a munitions projectile fired using an explosive or propellant, the system comprising the system of claim 14.

* * * * *